United States Patent [19]

Saxon

[11] 4,050,112

[45] Sept. 27, 1977

[54] INDUSTRIAL FLOOR CLEANING MACHINE WITH VACUUM DUST COLLECTOR

[76] Inventor: Bernhard Saxon, 170 Concord St., Nashua, N.H. 03060

[21] Appl. No.: 695,972

[22] Filed: June 14, 1976

[51] Int. Cl.[2] ..... A47L 5/30; A47L 5/34

[52] U.S. Cl. ..... 15/300 A; 15/351; 15/368; 15/383; 15/388; 15/392

[58] Field of Search ..... 15/350, 351, 366, 368, 15/372, 377, 383, 388, 389, 391, 392, 413, 300 A

[56] References Cited

U.S. PATENT DOCUMENTS

| | | | |
|---|---|---|---|
| 1,089,800 | 3/1914 | Stamm | 15/388 X |
| 1,350,664 | 8/1920 | Merriman | 15/388 X |
| 1,772,530 | 8/1930 | Whitlock | 15/392 X |
| 1,903,794 | 4/1933 | Richardson et al. | 15/392 X |
| 2,126,383 | 8/1938 | Grothe | 15/413 X |
| 2,130,325 | 9/1938 | Pardee | 15/392 X |
| 2,997,730 | 8/1961 | Dierks | 15/368 |
| 3,031,710 | 5/1962 | Huening, Jr. | 15/350 X |

FOREIGN PATENT DOCUMENTS

| | | | |
|---|---|---|---|
| 840,333 | 1/1939 | France | 15/366 |

*Primary Examiner*—Christopher K. Moore
*Attorney, Agent, or Firm*—Lee A. Strimbeck

[57] ABSTRACT

A heavy-duty floor-cleaning machine for such work as cleaning encrusted diamond-plate catwalks in ship engine rooms comprises a housing on wheels spacing it from the floor with the housing containing a rotating cylindrical wire brush driven by belts by an electric motor mounted rearward thereof inside the housing. The shaft of the wire brush is mounted in manually adjustable supports that permit the wire brush to be lowered with respect to the housing as brush wear occurs. The electric motor also drives air impellers or fans that expel air and debris from the housing into a collecting bag in the manner of a vacuum cleaner.

5 Claims, 5 Drawing Figures

70
73
58
65
62
10
57
71
75
55
50
67
76
56
29
80
33
60
63
72
52
30
51
64
12
51
13
32
36
35
16
16
11
15
11
20
15

10
82
60
X
16
65
16
72
76
15
11
35
20
32
15
71
75
11
72
58
55
12
33
62
56
67
65
61
15
50
13
30
57
67
65
61
56
62
72
58
55
12
33
71
11
75
76
15
11
35
20
32
15
72
16
65
16
60
X

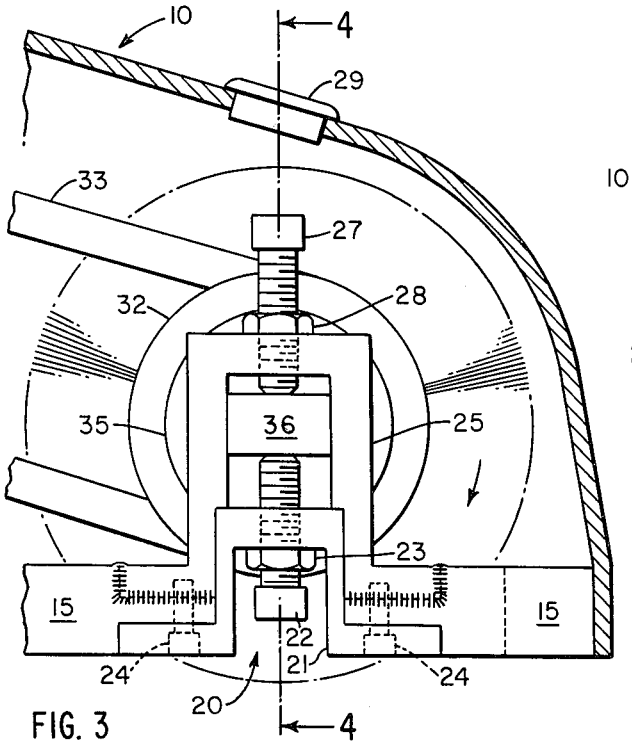
FIG. 3
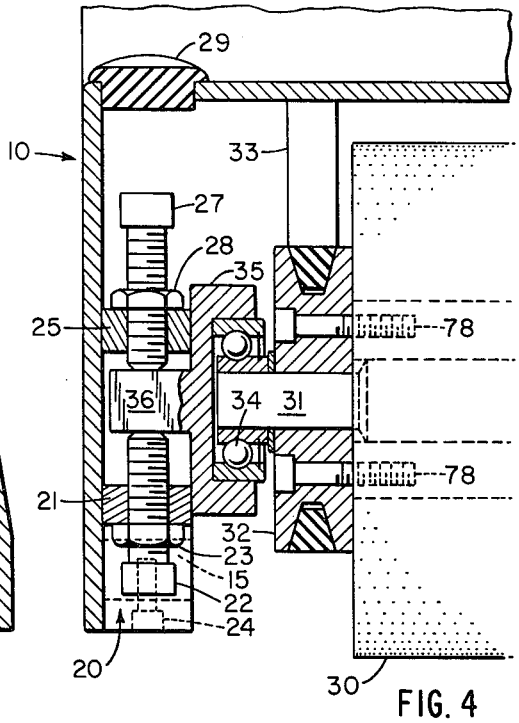
FIG. 4
FIG. 5
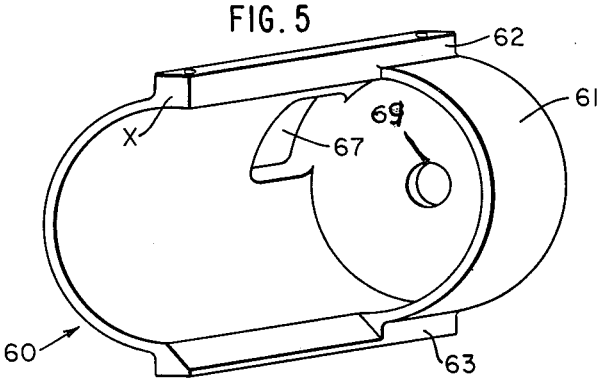

INDUSTRIAL FLOOR CLEANING MACHINE WITH VACUUM DUST COLLECTOR

INTRODUCTION

Diamond plate is used in the construction of the decks and catwalks of marine engine rooms and in submarines. In time it can become heavily encrusted with rust, dirt and the like. In the past such encrustations have usually been laboriously removed by hand or with hand-held tools because many of the catwalks and passageways are quite narrow, 2 feet or so in width. When done by hand, the cleaning operation is of course quite messy as the debris produced must be cleaned up separately at a later time. The present inventor has served for years as a marine engineering officer in charge of ship engine rooms and he is not aware that any heavy-duty machine is available suitable for mechanically removing encrustations of this type in tight quarters while simultaneously sucking up the debris produced by the cleaning.

While the present invention is particularly addressed to this problem in the marine field, it will be apparent to the skilled in the art that the cleaning machine can also be used in other like situations, such as in power plants on land to clean the catwalks and the floors thereof and in steel mills and in steel yards to clean steel plate that may have rusted in storage.

THE DRAWINGS

FIG. 3 is a detailed side view of the adjustable mounting means for the cylindrical brush.

FIG. 4 is a front cross-sectinal view of said mounting means taken along the line 4—4 of FIG. 3.

FIG. 5 is a prospective view of one of the fan or air impeller ducts.

In the drawings the same parts have the same numbers throughout.

DESCRIPTION

Figure 1:
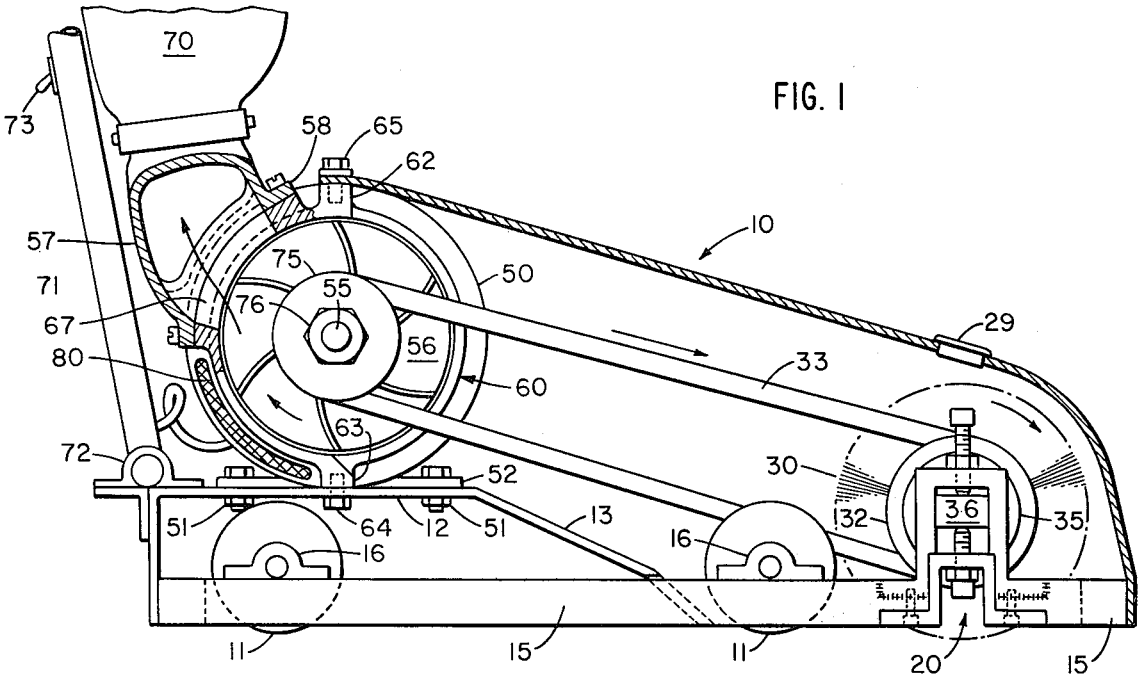
FIG. 1 is a side view of the machine with the side wall of the housing removed to permit a view of the interior components.
Figure 2:
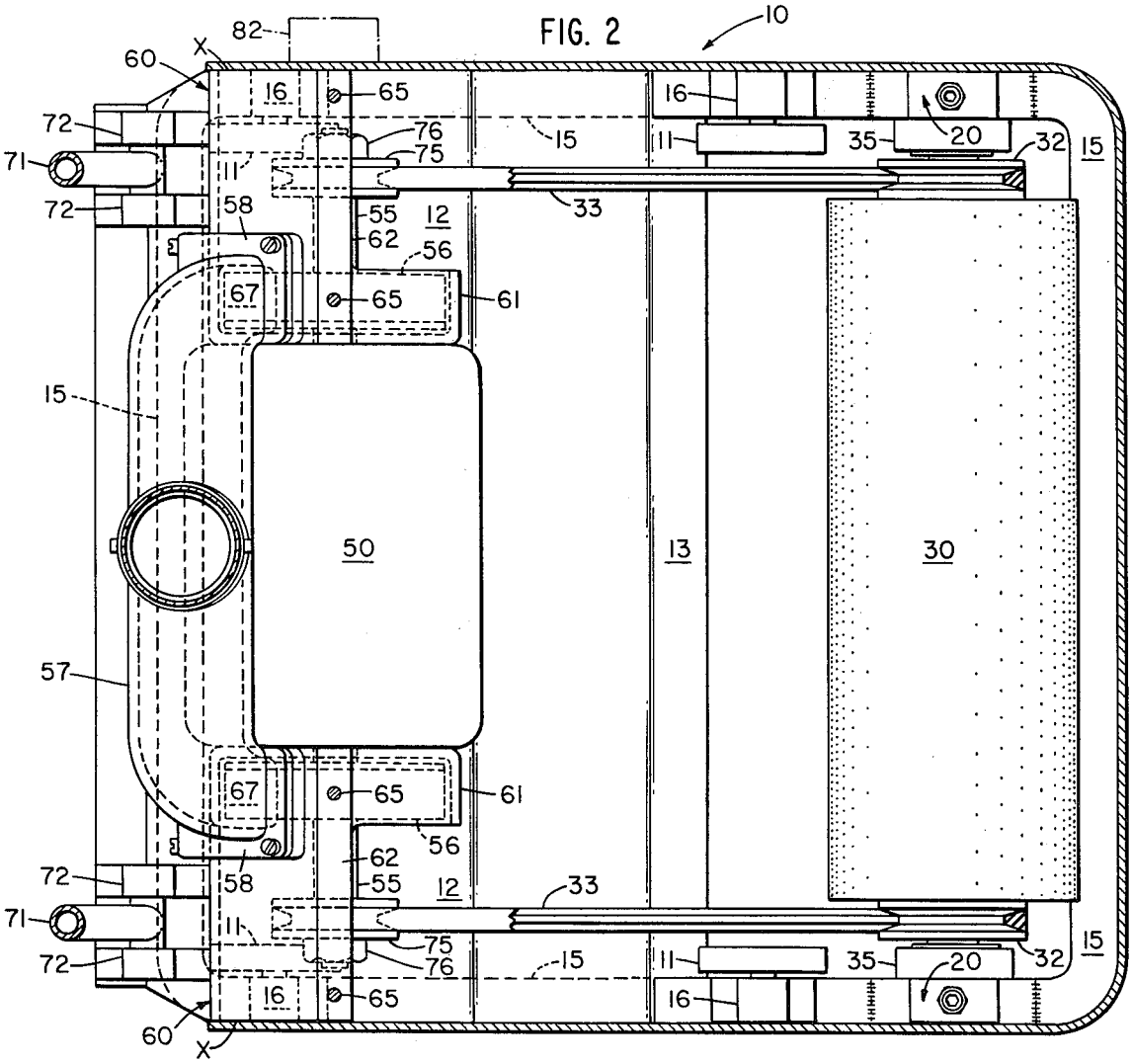
FIG. 2 is a top view with the top of the housing removed to permit a view of the interior components.

Referring to the drawings, the housing is generally shown at 10, the wire brush at 30, and the electric motor drive unit at 50.

Housing 10 can be made of rolled and welded steel plate, cast aluminum, molded of a plastic such as ABS, and the like. The housing has four wheels 11 that space it from the floor. The bottom of the housing is a plate 12, which mounts and supports the electric motor 50 and the handle 71 of the machine. The leading edge of plate 12 is a ramp 13 that guides air and debris from the rear of brush 30 upward towards the air impellers by the motor. Bar or channel stock 15 runs around the bottom edges of the skirt of the housing 10 to reinforce it and to give support for the mountings 16 for wheels 11 and for the adjusting means, shown generally at 20, supporting brush 30.

Brush 30 is carried on a shaft 31 and has on either end driven pulleys 32 affixed to the brush body by screws 78 (see FIG. 4). The pulleys are driven by V-belts 33. Shaft 31 is carried in bearings 34 which in turn are fixed against rotation and are carried in housings 35. Studs 36 on housings 35 are mounted in the adjusting means 20.

With particular reference to FIGS. 3 and 4, adjusting means 20 comprises a lower mount 21 having a lower adjusting screw 22 with lock nut 23. Mount 21 is held into a suitable mating slot in bar 15 by screw 24 so as to be removable and to permit dropping out of stud 36 with the brush 30 to allow replacement thereof. The upper mount 25 of adjusting means 20 is U-shaped in cross section and is permanently affixed to bar 15 as shown by being welded into a mating slot therefor. The upper portion of the lower mount, which is also U-shaped but smaller, nestles therein and the two mounts define between them a flat sided slot mating with stud 36 which is rectangular in cross section and held against turning by the flat sides. Upper mount 25 carried an upper adjusting screw 27 with its lock nut 28. A removable rubber plug 29 is placed in the housing above screw 27 to permit access thereto. Both screws 22 and 27 can have Allen heads. The two screws 22 and 27 work against one another on stud 36 such that stud 36 can be positioned vertically in the slot to accommodate brush wear.

The electric motor 50 is carried on supports 52 which are in turn mounted to plate 12 by four bolts 51 (see FIG. 1). The bolt holes in support 52 are slotted to permit horizontal adjustment of the position of the motor. Motor 50 has a shaft 55 mounted to which are impellers 56 on either side of the motor. The impellers are shaped to blow air and debris from the housing via a duct 57.

Drive pulleys 75 are mounted on shaft 55 to the outside of impellers 56 and are held onto the shaft by nuts 76. The pulleys can be keyed to the shaft if desired. Drive belts 33 engage pulleys 75.

Motor 50 is disposed between two identical (but "mirror image") casings 60, one of which is shown in FIG. 5. These casings engage at the surface marked "*x*" with the skirt of the housing 10 and together with motor 50 form the rear portion of the machine as housing 10 ends at the upper edge 62 thereof. The casings carry at their ends housings 61 for the impellers 56, which housings connect with duct 57 at bolted-together flanges 58. The shaft 55 of the motor extends through opening 69. The housings have an upper longitudinal frame member 62 and a similar lower one 63. The lower one serves to mount the housing 60 to plate 12 by means of bolts 64. The upper member 62 holds housing 10 mounted to it by bolts 65.

Motor 50 has an opening 80 to admit cooling air from outside of the housing. Motor 50 has an internal fan (not shown) to force cooling air to flow through the motor. This air is then expelled from the other end of the motor into the impeller there through an opening in the impeller housing wall (not shown).

Duct 57 connects to a dust bag 70 mounted to the handle 71 for the machine. Handle 71 is pivotedly mounted to plate 12 by lugs 72. Handle 71 carries a switch 73 for turning on the machine. An electric cord (not shown) connects the machine to a suitable outlet.

The operation of the machine is quite straightforward. When the power is supplied and turned on, the motor drives the belt 33 and brush 30 in the direction shown by the arrows. The debris loosened by the brush and the air flowing in and around the brush passes up over ramp 13 to impellers 56 which then expel them from the housing 10 up into the dust bag via ducts 57.

If the setting of the brush is too low, that is too far out of the housing, the machine tends to jump and chatter in use. If the brush is retracted too much into the housing, it will not, of course, clean efficiently. As the brush wears, it can be progressively lowered by means of the adjusting screws 22 and 27.

In applications where the use of a steel brush would be too rigorous, such as the cleaning of a cement floor, a fiber brush can be used in the machine.

The design of the present machine is such that a power take-off can be placed at either end of shaft 55 of the electric motor outside of the housing. A flexible shaft could then be connected to such power take-off to be used to drive a hand-held small thin brush for getting at the edges and into corners.

What is claimed is:

1. A floor-cleaning machine comprising:

a. a housing, said housing being supported by wheels mounted to said housing and spacing said housing a fixed distance from a floor to be worked on;

b. a horizontally-positioned, elongated, cylindrical cleaning member in the forward part of said housing, the lower edge of said cleaning member extending through an opening in the bottom of said housing into a position to contact to said floor, a first shaft mounting said cylindrical cleaning member, a driven pulley on each side of said cylindrical cleaning member and affixed to said first shaft, a bearing on each side of said cleaning member mounting said first shaft for rotation, and a manually adjustable mounting means mounting each of said bearings to said housing, each mounting means having adjustable chocks holding said bearings and permitting setting of the spacing of said cylindrical cleaning member from said floor, said mounting means comprising upper and lower opposed vertically disposed threaded screws acting on such chocks; and c. an electric motor driving unit mounted in said housing rearward of said cylindrical cleaning member, said driving unit having a drive shaft, an air impeller mounted to and driven by said drive shaft on each side of said driving unit and configured to expel air from said housing, a drive pulley mounted on each end of said drive shaft to the outside of said air impellers, a drive belt connecting said drive pulley to said driven pulley, and ducts guiding air flowing from said impellers to the exterior of said housing, said housing having a baffle plate for the bottom side thereof that is parallel to and spaced from said floor and supports said driving unit, the forward edge of said baffle plate ending in a downwardly directed ramp that guides debris and air flowing from said lower edge of said cylindrical cleaning member up towards said air impellers.

2. The floor-cleaning machine of claim 1 comprising in addition a pivotable, elongated handle for an operator affixed to the exterior of said housing and a dust bag supported by said handle and connecting to said ducts to receive the discharge therefrom.

3. The floor-cleaning machine of claim 1 wherein said elongated cleaning member is a cylindrical wire brush.

4. The floor-cleaning machine of claim 1 wherein said driving unit has its own housing and in the interior thereof means for circulating cooling air from one end to the other and comprising in addition a second duct for admitting air from the exterior of said housing to said one end of said driving unit.

5. The floor-cleaning machine of claim 1 wherein the width of the machine does not exceed 22 inches.

* * * * *